US007249957B2

(12) United States Patent
Watanabe et al.

(10) Patent No.: US 7,249,957 B2
(45) Date of Patent: Jul. 31, 2007

(54) CONNECTOR FIXING STRUCTURE

(75) Inventors: Hiromichi Watanabe, Hyogo (JP); Yoshifumi Fukatsu, Hyogo (JP); Yasuo Nishioka, Hyogo (JP)

(73) Assignee: Fujitsu Ten Limited, Kobe (JP)

( * ) Notice: Subject to any disclaimer, the term of this patent is extended or adjusted under 35 U.S.C. 154(b) by 0 days.

(21) Appl. No.: 10/968,092

(22) Filed: Oct. 20, 2004

(65) Prior Publication Data

US 2005/0118864 A1 Jun. 2, 2005

(30) Foreign Application Priority Data

Oct. 21, 2003 (JP) ..... P2003-361306

(51) Int. Cl.
*H01R 12/00* (2006.01)

(52) U.S. Cl. ..... 439/79

(58) Field of Classification Search ..... 439/76.2, 439/79, 81, 80, 576, 577
See application file for complete search history.

(56) References Cited

U.S. PATENT DOCUMENTS 5,392,197 A * 2/1995 Cuntz et al. ..... 361/818
5,473,109 A * 12/1995 Plankl et al. ..... 174/363
5,593,307 A * 1/1997 Bale et al. ..... 439/79
5,703,754 A * 12/1997 Hinze ..... 361/736
5,823,830 A * 10/1998 Wurster ..... 439/751
5,865,645 A * 2/1999 Embo et al. ..... 439/567
6,016,083 A * 1/2000 Satoh ..... 333/12
6,319,023 B2 * 11/2001 Goto et al. ..... 439/79
2004/0145880 A1 7/2004 Watanabe et al.

FOREIGN PATENT DOCUMENTS

JP U 2-119514 9/1990
JP U 6-60067 8/1994
JP A 5-218669 8/1996
JP B2 2911043 4/1999

OTHER PUBLICATIONS

U.S. Appl. No. 10/968,066, filed Oct. 20, 2004, Watanabe et al.

* cited by examiner

*Primary Examiner*—Phuong Dinh
(74) *Attorney, Agent, or Firm*—Oliff & Berridge, PLC

(57) ABSTRACT

A connector fixing structure includes a substrate, a connector, and a housing. The substrate defines a first hole portion and a second hole portion. The connector includes a terminal of a pressfit shape that is inserted into the first holed portion to connect with the substrate electrically, and a housing having a leg portion of a press fit shape that is inserted into the second hole portion when the terminal is inserted into the first hole portion.

3 Claims, 6 Drawing Sheets

CONNECTOR FIXING STRUCTURE

BACKGROUND OF THE INVENTION

1. Field of the Invention

The present invention relates to a connector fixing structure for a pressfit terminal in which a connector for connecting with an outside can be attached to a printed circuit board without soldering.

2. Description of the Related Art

Conventionally, in various electronic control apparatuses, an electronic control portion containing a microcomputer is mounted on a printed circuit board, and enclosed in a casing for protection. An output portion such as an actuator and an input portion such as a keyboard and a sensor are disposed at required portions outside the casing. A wire harness connects between the output portion and the input portion. A removable connector is used in a connection portion between the wire harness and the electronic control portion. The connectors are used as a pair, one of which is attached at the distal end of the wire harness; and the other of which is attached to the printed wiring board. When the one connector is joined with the other connector, many input/output signal lines can be connected quickly and securely.

In recent years, lead free is required in soldering. In the conventional soldering, a leaded solder having an eutectic composition including about 60% of tin (Sn) and about 40% of lead (Pb), or its near composition, is often used. However, it becomes the dominant idea that the usage of lead is not preferable for the sake of health. Therefore, it is necessary to use the unleaded solder in soldering. In order to attain with the unleaded solder the electrical and mechanical properties equivalent to those of the conventional leaded solder, it is necessary to use solder under higher temperatures than the unleaded solder. If the soldering temperatures increase, there would arise a problem in the heat resistance of a housing of a connector.

JP-U-Hei.2-119514 and JP-B-2911043 disclose a technique for using a pressfit terminal that can electrically contact with a substrate without using solder. However, JP-U-Hei.2-119514 and JP-B-2911043 are silent on how a housing of a connector including the pressfit terminal is fixed to the substrate.

JP-A-Hei.5-218669 has proposed a mechanism in which a connector that detachably connects printed circuit boards is supported by the printed circuit board without screwing. In JP-A-Hei.5-218669, an elastically deformable member protruding from the connector mounted on one of the printed circuit boards is inserted into and passed through a through-hole defined in the other printed circuit board with the elastically deformable member compressed in a diameter direction. Then, a distal end of the member passing through the other printed circuit board expands elastically, thereby supporting the other printed circuit board.

JP-U-Hei.6-60067 has proposed a structure in which when a surface-mounted connector is fixed onto a printed circuit board, a leg portion provided on a bottom surface of a housing is inserted into and fixed to a hole defined in the printed circuit board. A protrusion for preventing disengagement is formed inside the hole.

SUMMARY OF THE INVENTION

For the higher productivity, it has been demanded that a pressfit connector sufficiently holds a substrate only through a process of press fitting a terminal. In JP-A-Hei.5-218669, the printed circuit boards can be supported by each other using the protrusion formed on the connector mounted onto the one of the printed circuit boards and the hole defined in the other printed circuit boards, without screwing. However, the structure of JP-A-Hei.5-218669 is for the purpose of positioning the printed circuit boards and the connector, but is not for the purpose of restricting external force such as pinch force caused when the connector is inserted/extracted. Also, if thickness of the printed circuit boards get thinner in the structure of JP-A-Hei.5-218669, play (clearance) is defined between the protrusion and the hole. As a result, the fixing becomes instable. Therefore, when the connector is inserted/extracted, the external force such as pinch force directly acts on a connection portion between the terminal and the printed circuit boards.

In JP-U-Hei.6-60067, a terminal for electrical conduction is mounted on a surface by soldering. Therefore, the fixing of the terminal and the fixing of the connector cannot be conducted at one time. Also, when the connector is immersed in a solder bath in a molten state in the soldering process, the connector floats. Therefore, it is necessary to fix the printed circuit board and the connector in order to prevent the connector from floating.

The invention provides a connector fixing structure that can fix a housing at the same time when a pressfit terminal is inserted.

According to one embodiment of the invention, a connector fixing structure includes a substrate and a connector. The substrate defines a first hole portion and a second hole portion. The connector includes a terminal of a pressfit shape and a housing. The terminal is inserted into the first holed portion to connect with the substrate electrically. The housing has a leg portion of a pressfit shape that is inserted into the second hole portion when the terminal is inserted into the first hole portion.

With this configuration, the terminal of the pressfit shape is used as a terminal for electrical connection. Therefore, there is no need for providing the connector with a fixing member that fixes the connector and the substrate for preventing the connector from floating during a soldering process. Also, the housing has the leg portion of the pressfit shape that is inserted into the second hole portion of the substrate when the terminal is inserted into the first hole portion. Therefore, the housing can be fixed by inserting the leg portion into the second hole portion of the substrate simultaneously at the time when the terminal is inserted into the first hole portion.

According to one embodiment of the invention, a connector fixing structure includes a substrate, a casing, a connector, and an engagement portion. The casing stores the substrate therein. The connector includes a terminal of a pressfit shape that is connected to the substrate electrically, and a housing. The casing engages with the housing by the engagement portion. The engagement portion is disposed at a position where the housing and the casing contact with each other.

With this configuration, the terminal of the pressfit shape is used as a terminal for electrical connection. Therefore, there is no need for providing the connector with a fixing member that fixes the connector and the substrate for preventing the connector from floating during a soldering process.

Also, the engagement portion may include a leg portion having a pressfit shape, and a hole portion into which the leg portion is inserted. With this configuration, the connector and the substrate are fixed using the leg portion having the pressfit shape.

DETAILED DESCRIPTION OF THE PREFERRED EMBODIMENT

Figure 1A:
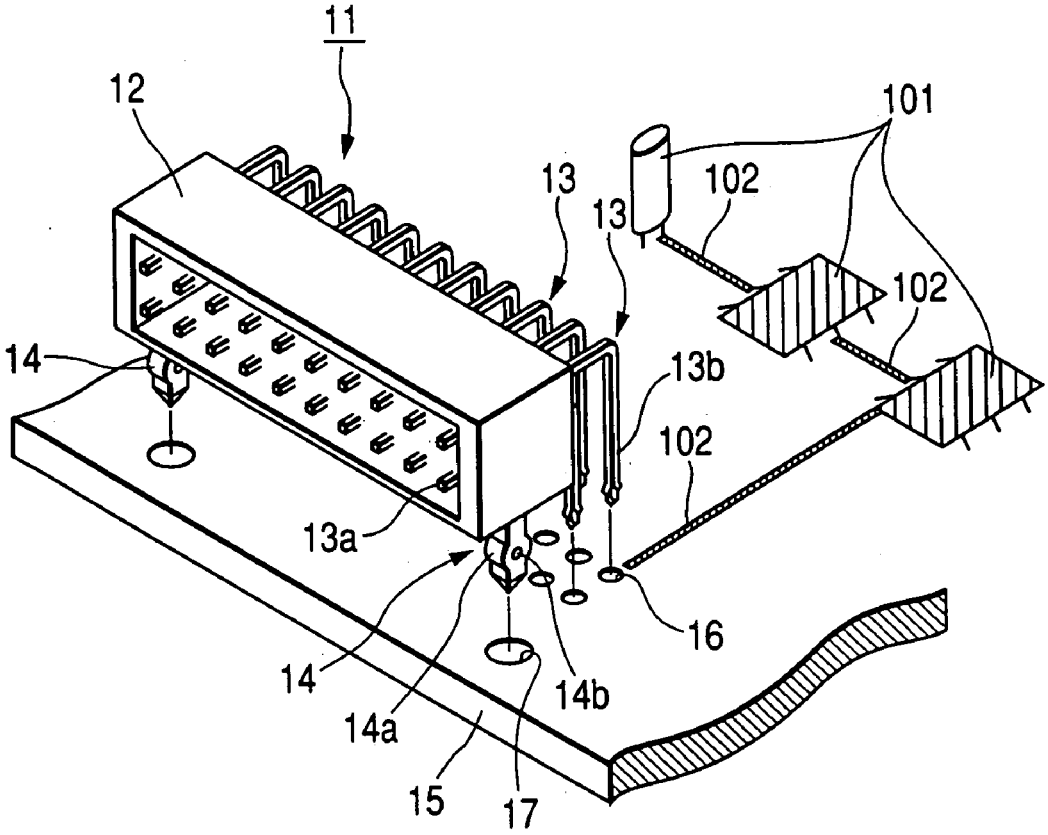
FIG. 1 is a perspective view showing the configuration relating to fixing of a press fit terminal connector 11 according to an embodiment of the invention and a process for the fixing.

FIG. 1 shows the configuration relating to fixing of a pressfit terminal connector 11 according to an embodiment of the invention and a process for the fixing. As shown in the fixing configuration of FIG. 1A, the pressfit terminal connector 11 includes plural terminals 13 held at regular intervals on a housing 12. The housing 12 is made of a synthetic resin material having electrical insulation, and the terminals 13 are made of a metal material such as copper alloy having high conductivity and high elasticity. The housing 12 has an almost rectangular parallelopiped shape, in which one of the outer surfaces, for example, a front face in FIG. 1A, is opened. External connection portions 13*a* of the terminal 13 are provided in the housing 12 to project. The terminal 13 also projects from the rear side of the housing 12, and is bent roughly like L-character, whereby pressfit terminal portions 13*b* directed toward a bottom face are formed. Pressfit members 14 serving as a leg part project from the bottom face of the housing 12 in a direction parallel to the pressfit terminal portions 13*b*. From each of the pressfit members 14, a pair of projections 14*a* project near the distal end thereof in mutually opposite directions. Since a diameter expansion hole 14*b* is defined near the center of each projection 14*a* in the width direction of the press fit member 14, each projection 14*a* bulges outwards in the width direction to have an outer diameter larger than an inner diameter of an insertion hole 17 serving as a hole portion. When the projections 14*a* are inserted into the insertion holes 17, the projections 14*a* are compressed against the inner wall face of the insert ion hole 17. The press fit members 14 are not required to have conductivity, but are required to have high mechanical strength. Electronic parts 101 are mounted on the substrate 15 and are connected via wiring 102. As shown in FIG. 1A, a part of the electronic parts 101 is connected with the terminal 13 through the wiring 102.

Figure 6A:
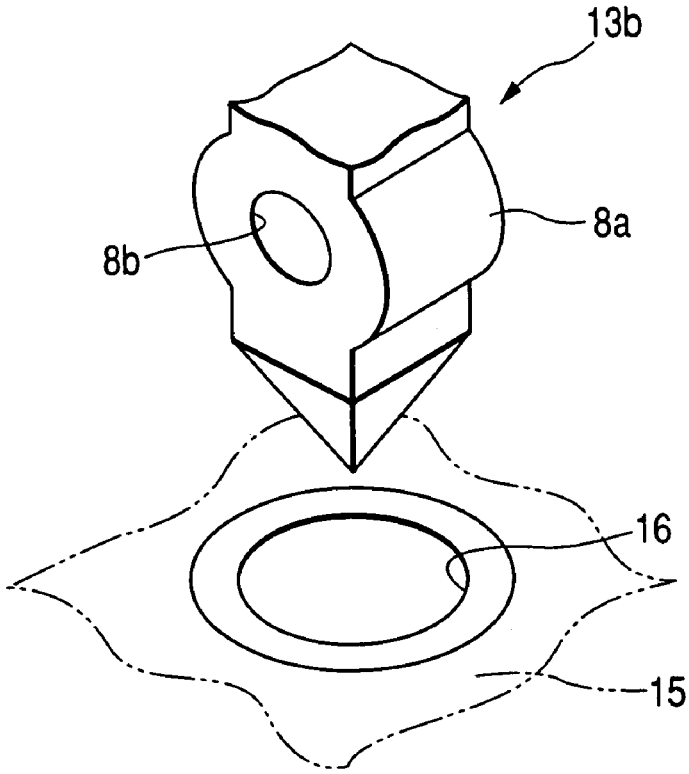
FIG. 6 is a perspective view showing the usage of a pressfit terminal according to the embodiment and a plan cross-sectional view showing a state of use.
Figure 6B:
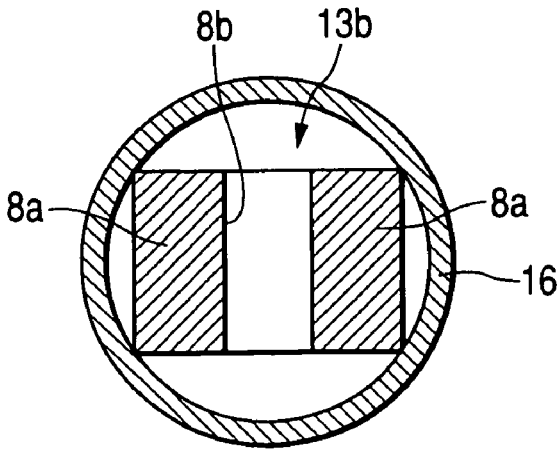

FIG. 6 shows the basic configuration of the pressfit terminal 13*b* that can make electrical connection without soldering. FIG. 6A shows a state where the pressfit terminal 13*b* is about to be inserted into the through hole 16 of the substrate 15. FIG. 6B shows a state where the pressfit terminal 13*b* is inserted into the through hole 16. As shown in FIG. 6A, the pressfit terminal 13*b* has a protruding portion 8*a*, diameters of which enlarges in comparison with the other portions, near the distal end thereof. The protruding portion 8*a* defines an enlarged-diameter hole 8*b* near the center thereof in a width direction. The enlarged-diameter hole 8*b* expands the peripheral portion outwardly in the width direction. As shown in FIG. 6B, within the through hole 16, the protruding portion 8*a* of the pressfit terminal 13*b* is in a compressed state where the protruding portion 8*a* abuts resiliently against the inner wall face of the through hole 16. Therefore, the reliable electrical connection is made between the pressfit terminal 13*b* and the through hole 16 without solder.

Figure 1B:
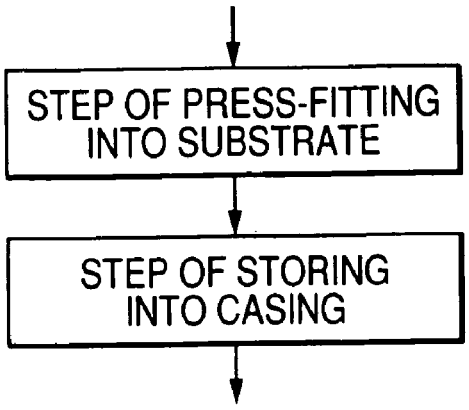
Figure 7:
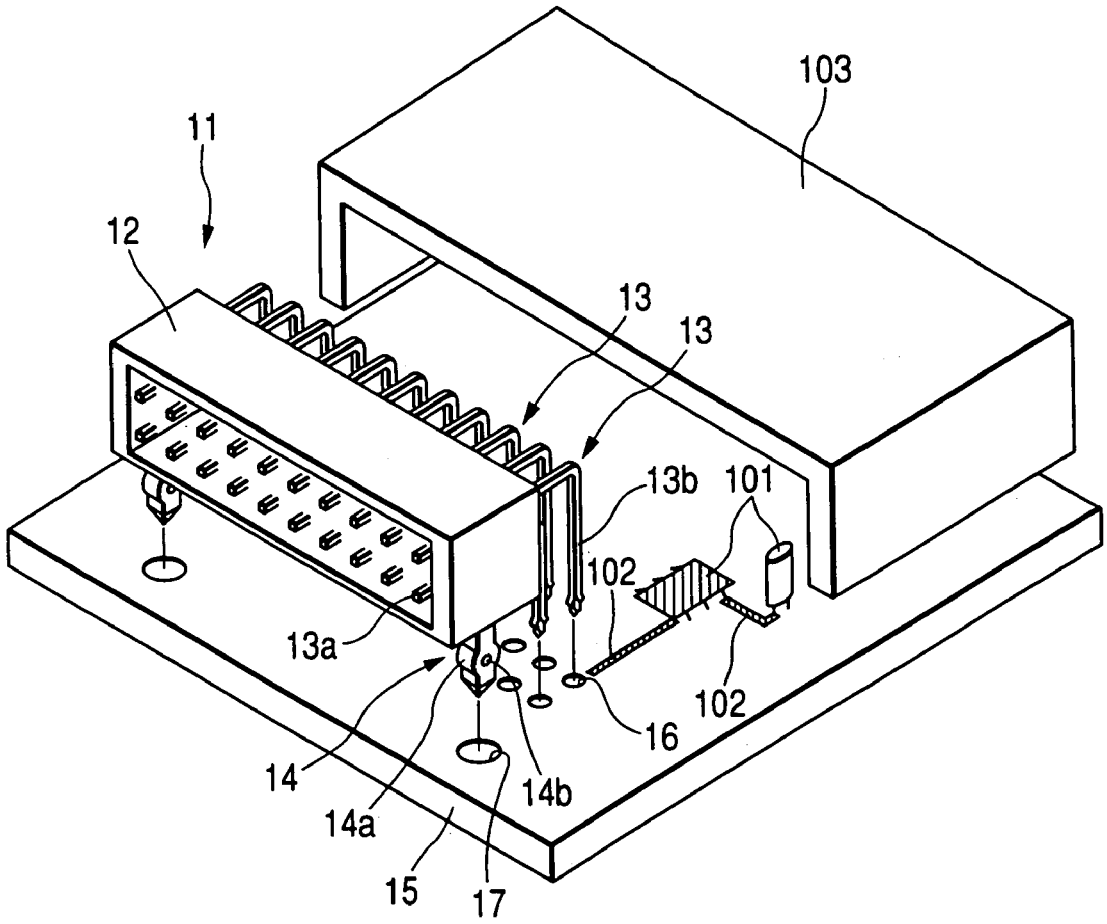
FIG. 7 is a perspective view showing a state where the substrate 15 is being stored in a casing 103 during the step of storing into casing.

As shown in FIG. 1B, if the pressfit terminal connector 11 is employed, a manufacturing process is simplified, so that productivity is improved. That is, in a step of press fitting into a substrate, each terminal of the pressfit terminal connector 11 and the pressfit members 14 are press fitted into the through hole 16 and the insertion holes 17 of the substrate 15. Neither the screwing process nor the soldering process is necessary in the subsequent step. In a step of storing into a casing, the substrate 15 with the pressfit terminal connector 11 attached is stored within the casing 103 for protection as shown in FIG. 7. Thereby, the housing 12 is mechanically supported only by inserting the pressfit members 14 into the insertion holes 17.

Figure 2:
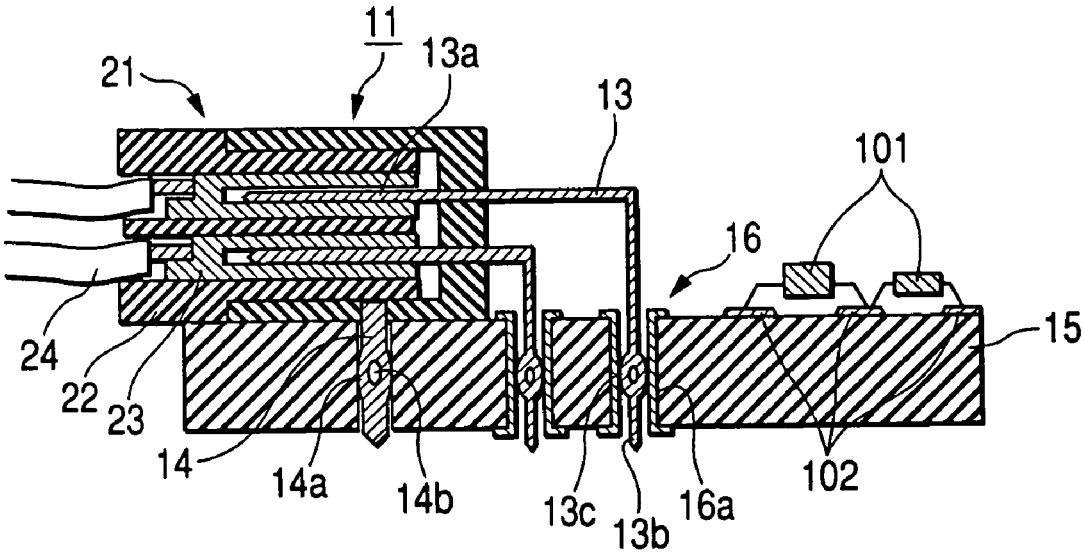
FIG. 2 is a side cross-sectional view showing a state where a wire harness connector 21 is connected to the pressfit terminal connector 11 of FIG. 1.

FIG. 2 shows a state where a wire harness connector 21 is connected to the pressfit terminal connector 11 of FIG. 1. It should be understood that the connector to be connected may be used to connect a ribbon cable or another substrate. The wire harness connector 21 is paired with the pressfit terminal connector 11. A housing 22 of the wire harness connector 21 is insertable into and engageable with the opening defined on the front face of the housing 12 for the pressfit terminal connector 11. The distal ends of terminals 23 project in the housing 22. Each terminal 23 engages with the external connection terminal portion 13*a* of the terminal 13 on the pressfit terminal connector 11 side. That is, each external connection terminal portion 13*a* has a plug shape, and each distal end of the terminal 23 has a socket shape. It should be understood that each external connection terminal portion 13*a* of the terminal 13 may have a socket shape, and that each terminal 23 may have a plug shape. Wirings 24 are joined at a base end of the terminals 23. Each wiring 24 is connected through the distal end of the terminal 23 to the external connection terminal portion 13*a* of the terminal 13, and further connected, through the pressfit terminal portion 13*b* and an inner wall face 16*a* of a through hole 16 in the substrate 15, to an electronic circuit mounted on the substrate 15. For the sake of explanation, the substrate 15 is drawn to be thick relatively.

When the wire harness connector 21 is attached to or detached from the pressfit terminal connector 11, there is possibility that a large external force may be applied onto the housing 12 so that the housing 12 is disengaged from the substrate 15. However, this embodiment can surely prevent such disengagement. When the pressfit terminal connector 11 is attached to the substrate 15, the pressfit terminal connector 11 is in a state where the bottom face of the housing 12 confronts the front face of the substrate 15; each pressfit member 14 serving as the insertion member projects in the direction parallel to the press fitting direction of each pressfit terminal portion 13*b*; and each pressfit member 14 is inserted into each insertion hole 17 serving as an insertion concave portion of the substrate 15. The projections 14*a* are compressed against the inner wall surfaces of the insertion holes 17, so that each compression portion between the projection 14*a* and the inner wall surface of the insertion hole 17 restricts disengagement of the housing 12 from the substrate 15 in an opposite direction to the insertion direction. Therefore, even if a large external force is applied onto the housing 12 during attachment/detachment of the wire harness connector 21, the housing 12 of this embodiment is surely prevented from being disengaged from the substrate 15.

Shape of a projection 13*c* of the pressfit terminal portion 13*b* and shape of the projection 14*a* of the pressfit member 14 are not limited to those shown in FIG. 2, but may be formed in various ways, as illustrated in JP-U-Hei.2-119514 and JP-B-2911043, which are incorporated herein by reference in its entirety. Also, insertion of the terminal 13 into the through hole 16 should be made with a lower insertion force in consideration of damage on the substrate 15 and the electrical insulation between the through holes 16. However, insertion of the pressfit member 14 into the insertion hole 17 may be made with a larger insertion force because spacing between adjacent patterns can be enhanced. The pressfit member 14 projects from the bottom face of the housing 12 to reduce a space required for packaging. However, a portion extending in a side direction of the housing 12 may be provided and the pressfit member 14 may project from the extended portion. In particular, when the terminal 13 is not bent like L-character, but the pressfit terminal portion 13*b* projects linearly from the bottom face of the housing 12 confronting the substrate 15 and is attached on the substrate 15, it is required that the pressfit member 14 projects from more outside portion in width direction than the portion where the pressfit terminal portion 13 projects.

Figure 3:
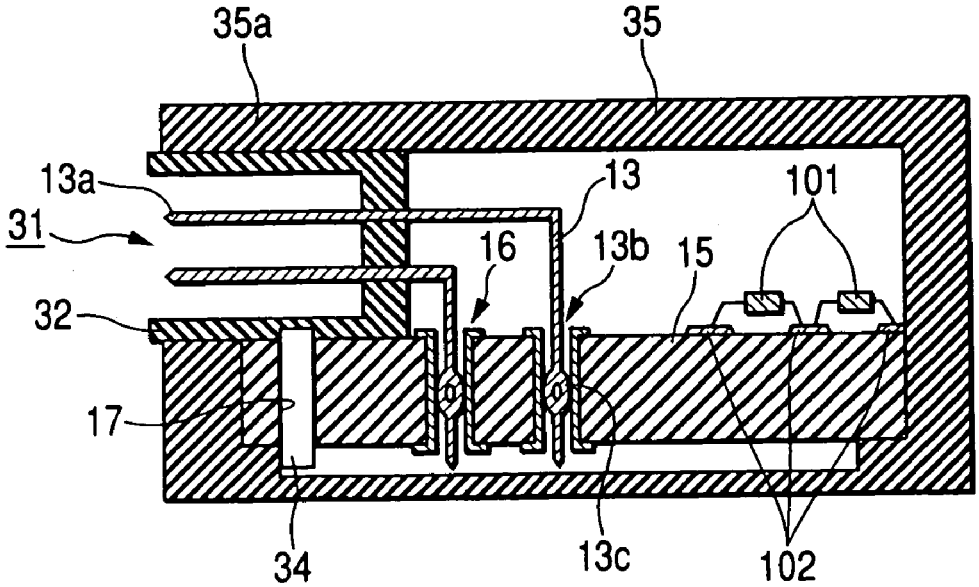
FIG. 3 is a side cross-sectional view showing the schematic configuration relating to fixing of a pressfit terminal connector 31 according to another embodiment of the invention.

FIG. 3 shows the schematic configuration relating to fixing of a pressfit terminal connector 31 according to another embodiment. In this embodiment, parts corresponding to the embodiment of FIG. 1 are designated by the same reference numerals, and will not be described again. A housing 32 of the pressfit terminal connector 31 has a similar shape to the housing 12 of FIG. 1, except that a straight insertion pin 34 serving as a leg part projects toward the substrate 15. The insertion pin 34 is inserted into the insertion hole 17 of the substrate 15, so that the insertion pin 34 can receive an external force in a direction perpendicular to the insertion direction. A casing 35 in which the substrate 15 is assembled and stored is used to regulate the insertion pin 34 in the insertion direction. That is, the casing 35 includes a regulating portion 35*a* for externally contacting with the housing 32 of the pressfit terminal connector 31 and preventing the insertion pin 34 from being disengaged in an opposite direction to the insertion direction. Here, it is not necessary that the insertion hole 17 penetrates through the substrate 15. The insertion hole 17 may be a concave portion formed halfway in the thickness of the substrate 15. Also, the shape of the insertion pin 34 may be made by thermal caulking or snap fit.

Although in the embodiments of FIGS. 1 to 3, the insertion member projects from the housing 12, 32 toward the substrate 15, the insertion member may project from the substrate 15 toward the housing 12, 32 and the concave portion for insertion may be defined in the housing 12, 32.

Figure 4A:
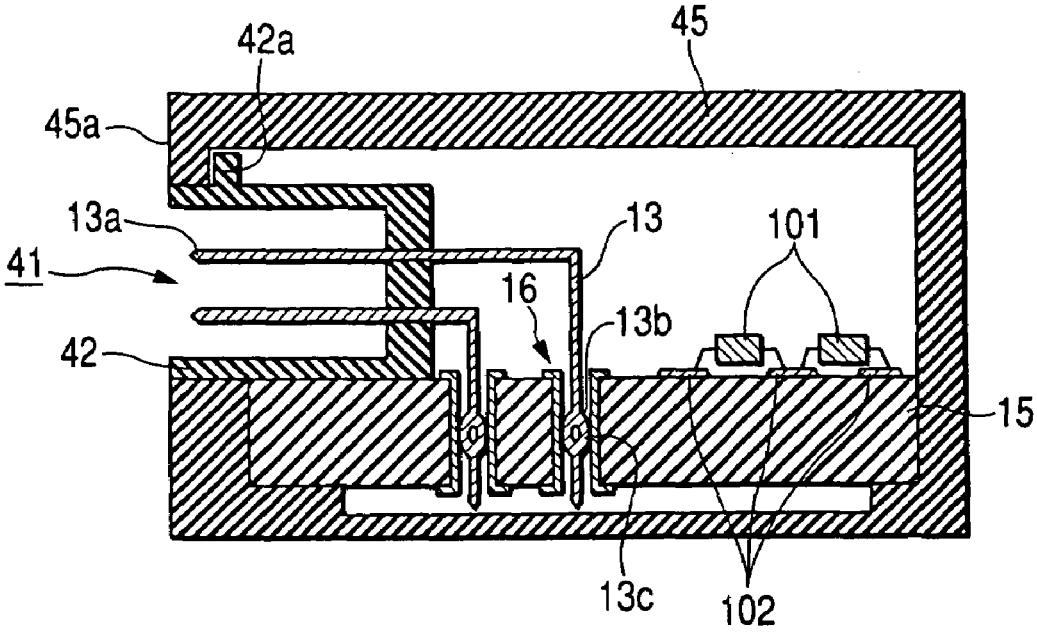
FIG. 4 is aside cross-sectional view showing the schematic configuration relating to fixing of a pressfit terminal connector 41 according to a further embodiment of the invention.
Figure 4B:
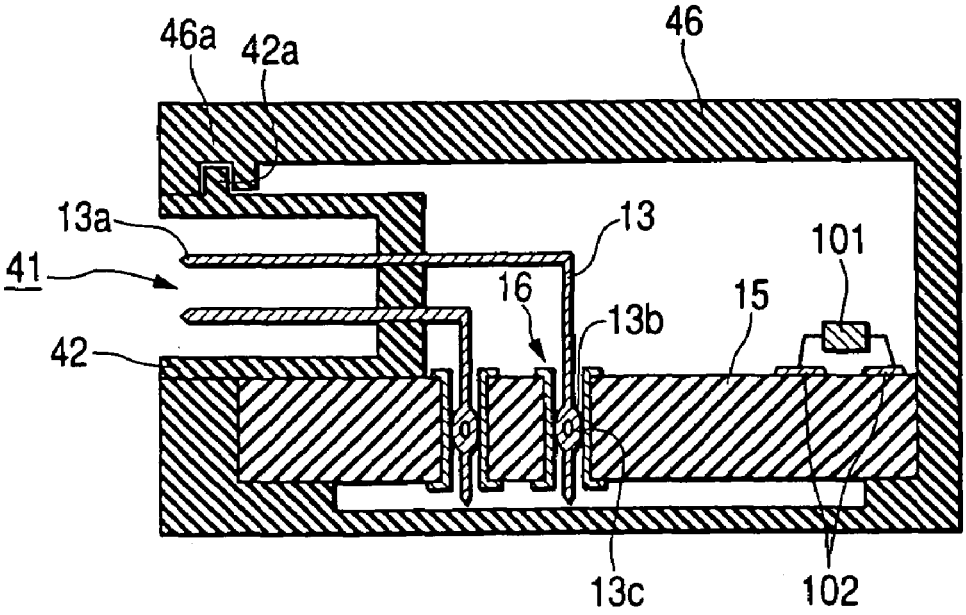

FIG. 4 shows the schematic configuration relating to fixing of a pressfit terminal connector 41 according to a further embodiment. In this embodiment, parts corresponding to the embodiment of FIG. 1 are designated by the same reference numerals, and will not be described again. A housing 42 of the press fit terminal connector 41 is substantially equivalent to the housing 12 of FIG. 1, except for that a projection piece 42*a* is formed on an upper face of the housing 42. As shown in FIG. 4A, a step portion 45*a* is provided on a casing 45. When the step portion 45*a* abuts against the projection piece 42*a*, the step portion 45*a* can receive an outward pulling force acting on the pressfit terminal connector 41. If the pressfit terminal connector 41 is one for connecting the wire harness, a pulling force is mainly applied there to after the attachment. Therefore, the pressfit terminal connector 41 can receive an external force with a simple configuration. The projection pieces 42*a* abuts against a ceiling plane of the casing 45 in the opposite direction to a press fitting direction of the pressfit terminal portion 13*b*, so that the pressfit terminal portion 13*b* can be prevented from being released due to a force applied to an opposite direction to the insertion direction of the pressfit terminal portion 13*b*. If the casing 45 defines a groove 46*a* engaging with the projection piece 42*a*, as shown in FIG. 4B, the casing 45 can deal with not only a pulling force but also a pushing force, and sufficiently receive an external force in attaching the wire harness.

Figure 5:
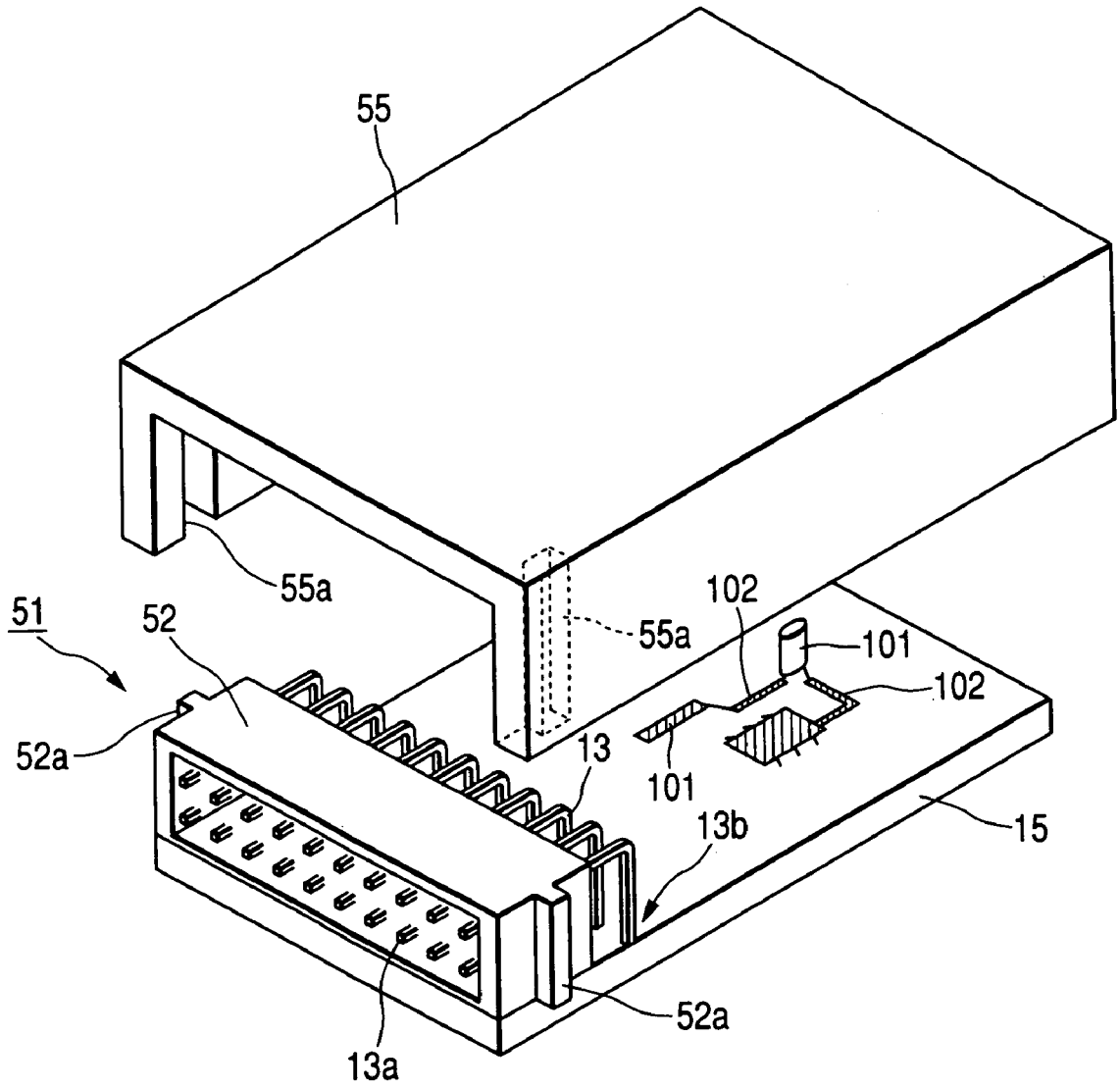
FIG. 5 is a perspective view showing the schematic configuration relating to fixing of a pressfit terminal connector 51 according to another embodiment of the invention.

FIG. 5 shows the schematic configuration relating to fixing of a pressfit terminal connector 51 according to still another embodiment of the invention. In this embodiment, parts corresponding to the embodiment of FIG. 1 are designated by the same reference numerals, and will not be described again. A housing 52 of the pressfit terminal connector 51 is substantially equivalent to the housing 12 of FIG. 1, except for that a projection piece 52*a* is formed at either side. A casing 55 defines a groove 55*a* engaging with the projection piece 52*a*, so that an external force acting on the pressfit terminal connector 51, either a pulling force or a pushing force, may be dealt with in the same way as in FIG. 4B. The external force in attaching the wire harness is sufficiently received.

It should be understood that both of the projection piece 42*a*, 52*a* of FIGS. 4 and 5 may be formed continuously and that the groove 45*a*, 55*a* may be defined continuously on the casing. Also, the groove may be defined on the housing 42, 52 and the projection piece may be formed on the casings 45, 55. In any event, the housing 42, 54 may include an engagement portion such as the projection piece 42*a*, 52*a* or groove, which is formed on the outer face thereof as a protrusion or a concave and a part of which extends in the press fitting direction of the pressfit terminal portion 13*b*. The casing 45, 55 may include an engaged portion such as the grooves 45*a*, 55*a* or *a* projection piece, which is engageable with the engagement portion. Furthermore, the pressfit member 14 maybe used as the engagement portion.

Further, the above embodiments may be combined desirably. For example, FIGS. 1 and 3 may be combined, that is, the pressfit member 14 and the insertion pin 34 may be used in combination to fix the housing with the substrate 15. Also, the pressfit member 14 or the insertion pin 34 and the fitting structure of FIG. 4 or 5 may be used in combination.

What is claimed is:

1. A connector fixing structure comprising:

a substrate;

a casing that stores the substrate therein;

a connector including:

an L-shaped terminal of a pressfit shape that is connected to the substrate electrically, the terminal having an enlarged-diameter hole near a center thereof in a width direction; and a housing that accommodates a mating connector, the housing provided in the casing and fixed onto the substrate only by the terminal; and an engagement portion by which the casing engages with the housing, the engagement portion disposed at a position where the housing and the casing contact with each other.

2. The structure according to claim 1, wherein the engagement portion includes:

a leg portion having a pressfit shape; and a hole portion into which the leg portion is inserted.

3. An electronic apparatus comprising:

a circuit board;

a casing that stores the circuit board therein;

a connector including:

an L-shaped terminal of a pressfit shape that is connected to the circuit board electrically, the terminal having an enlarged-diameter hole near a center thereof in a width direction; and a housing that accommodates a mating connector, the housing provided in the casing and fixed onto the substrate only by the terminal; and an engagement portion by which the casing engages with the housing, the engagement portion disposed at a position where the housing and the casing contact with each other.

* * * * *